US009250579B2

(12) United States Patent
Takahashi et al.

(10) Patent No.: US 9,250,579 B2
(45) Date of Patent: Feb. 2, 2016

(54) SEPARATOR, FIXING DEVICE, AND IMAGE FORMING APPARATUS

(71) Applicants: Kentaroh Takahashi, Kanagawa (JP); Yasutoshi Iwata, Tokyo (JP); Yoshiki Yamaguchi, Kanagawa (JP)

(72) Inventors: Kentaroh Takahashi, Kanagawa (JP); Yasutoshi Iwata, Tokyo (JP); Yoshiki Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 14/156,619

(22) Filed: Jan. 16, 2014

(65) Prior Publication Data

US 2014/0227013 A1 Aug. 14, 2014

(30) Foreign Application Priority Data

Feb. 13, 2013 (JP) ..... 2013-025322

(51) Int. Cl.
*G03G 15/20* (2006.01)

(52) U.S. Cl.
CPC ..... *G03G 15/2028* (2013.01)

(58) Field of Classification Search
USPC ..... 399/323
See application file for complete search history.

(56) References Cited

U.S. PATENT DOCUMENTS

2005/0013638 A1* 1/2005 Fukuda et al. ..... 399/323
2008/0159792 A1* 7/2008 Egi ..... G03G 15/2028 399/323
2009/0110452 A1 4/2009 Ogata
2011/0064451 A1 3/2011 Yamaguchi et al.
2013/0236225 A1 9/2013 Ogawa et al.

FOREIGN PATENT DOCUMENTS

JP 6-149114 5/1994
JP 2005-037567 2/2005
JP 2006-317492 11/2006
JP 2009-109574 5/2009

OTHER PUBLICATIONS

U.S. Appl. No. 13/929,920, filed Jun. 28, 2013.
U.S. Appl. No. 14/013,206, filed Aug. 29, 2013.
U.S. Appl. No. 14/014,653, filed Aug. 30, 2013.
U.S. Appl. No. 14/010,823, filed Aug. 27, 2013.
U.S. Appl. No. 14/024,931, filed Sep. 12, 2013.
U.S. Appl. No. 14/015,035, filed Aug. 30, 2013.

* cited by examiner

*Primary Examiner* — W B Perkey
*Assistant Examiner* — Linda B Smith
(74) *Attorney, Agent, or Firm* — Oblon, McClelland, Maier & Neustadt, L.L.P.

(57) ABSTRACT

A separator is provided for a fixing device including a rotary fixing member that fixes a toner image on a recording medium and a rotary pressure member pressed against the rotary fixing member to form a fixing nip portion for nipping the recording medium. The separator includes a separation plate and plate-shaped spacers. The separation plate is disposed downstream of the fixing nip portion in a medium feeding direction, with an edge portion of the separation plate facing an outer circumferential surface of the rotary fixing member or the rotary pressure member. The spacers are disposed between portions of the edge portion of the separation plate and the outer circumferential surface of the rotary fixing member or the rotary pressure member to surround the portions of the edge portion in a direction intersecting with an extending direction of the edge portion.

19 Claims, 11 Drawing Sheets

SEPARATOR, FIXING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2013-025322, filed on Feb. 13, 2013, in the Japan Patent Office, the entire disclosure of which is hereby incorporated by reference herein.

BACKGROUND

1. Technical Field

The present invention relates to a separator, a fixing device including the separator, and an image forming apparatus including the fixing device.

2. Related Art

An electrophotographic image forming apparatus, such as a copier, a printer, a facsimile machine, or a multifunction machine combining the functions of these apparatuses, performs image formation by forming an electrostatic latent image on an image carrier, developing the electrostatic latent image with a development device to form a toner image, transferring the toner image onto a recording medium, and fixing the toner image on the recording medium with a fixing device.

Such a fixing device includes a rotary fixing member, such as a fixing roller or a fixing belt, and a rotary pressure member, such as a pressure roller, disposed facing and pressed against the rotary fixing member to form a fixing nip portion. The fixing device fixes the toner image on the recording medium with heat and pressure by having the recording medium fed through and nipped by the fixing nip portion formed between the rotary fixing member and the rotary pressure member.

To prevent the recording medium having passed through the fixing nip portion from winding around the rotary fixing member or the rotary pressure member (hereinafter simply referred to as the rotary member), the fixing device further includes a separator for separating the recording medium from the rotary member. The separator has a substantially planar band shape, for example, and disposed parallel to the axial direction of the rotary member, with an edge portion in the lateral direction (i.e., a long edge portion) of the separator located close to and facing the outer circumferential surface of the rotary member across a certain predetermined gap. If the gap is too narrow, the separator and the rotary member may come into contact with each other, generating stress on the rotary member. If the gap is too wide, the recording medium may pass through the gap and wind around the rotary member without separating therefrom. Therefore, the separator is provided with a positioning mechanism for providing an appropriate gap between the separator and the rotary member.

For example, as illustrated in FIGS. 1 to 3, the fixing device may include a separator 817 including a planar band-shaped separation plate 830 having surfaces formed with a fluororesin layer 832, a bracket 831 for supporting the separation plate 830, and positioning members 836 formed integrally with opposed end portions of the separation plate 830 by bending, for example. The separation plate 830 may be superimposed on and attached to an outer surface 831*a* of the bracket 831, with an edge portion 830*a* in the lateral direction of the separation plate 830 projecting from an edge portion of the bracket 831. The shape and so forth of the positioning members 836 may be determined such that, when the positioning members 836 come into contact with a rotary shaft 838 of a fixing roller 837, a predetermined gap is formed between the edge portion 830*a* (specifically, the fluororesin layer 832 covering the edge portion 830*a*) and the surface of the fixing roller 837.

Alternatively, as illustrated in FIGS. 4 to 6, the fixing device may include a separator 938 having opposed end portions attached with positioning members (i.e., contact members) 939. The shape and so forth of the positioning members 939 may be determined such that, when the positioning members 939 come into contact with opposed end portions of the outer circumferential surface of a fixing roller 921, a predetermined gap is formed between an edge portion 938*a* of the separator 938 and the fixing roller 921.

In the above-configured separator 817, however, the positioning members 836 are provided at respective positions separated from the edge portion 830*a* of the separation plate 830 (specifically, the fluororesin layer 832 covering the edge portion 830*a*), which forms the gap between the edge portion 830*a* and the fixing roller 837. Therefore, the shape tolerance of the positioning members 836 and the separation plate 830, for example, may affect the gap, reducing the accuracy with which the gap is formed.

Also in the above-configured separator 938, the positioning members 939 are provided at respective positions separated from the edge portion 938*a* of the separator 938, which forms the gap between the edge portion 938*a* and the fixing roller 921. Therefore, the shape tolerance of the positioning members 939 and the separation plate 938 and the installation tolerance of the positioning members 939 may affect the gap, reducing the accuracy with which the gap is formed, similarly as in the separator 817.

SUMMARY

The present invention provides an improved separator for use in a fixing device including a rotary fixing member that fixes a toner image on a recording medium and a rotary pressure member pressed against the rotary fixing member to form a fixing nip portion for nipping the recording medium between the rotary pressure member and the rotary fixing member. The separator includes, in one example, a separation plate and plate-shaped spacers. The separation plate is disposed downstream of the fixing nip portion in a medium feeding direction, with an edge portion of the separation plate facing an outer circumferential surface of the rotary fixing member or the rotary pressure member. The spacers are disposed between portions of the edge portion of the separation plate and the outer circumferential surface of the rotary fixing member or the rotary pressure member to surround the portions of the edge portion in a direction intersecting with an extending direction of the edge portion.

The present invention further provides an improved fixing device that, in one example, includes a rotary fixing member, a rotary pressure member, and the above-described separator. The rotary fixing member is configured to fix a toner image on a recording medium. The rotary pressure member is configured to be pressed against the rotary fixing member to form a fixing nip portion for nipping the recording medium between the rotary pressure member and the rotary fixing member. The separator is configured to separate the recording medium from the rotary fixing member or the rotary pressure member.

The present invention further provides an improved image forming apparatus that, in one example, includes an image forming unit configured to form a toner image on a recording medium and the above-described fixing device configured to fix the toner image formed on the recording medium by the image forming unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
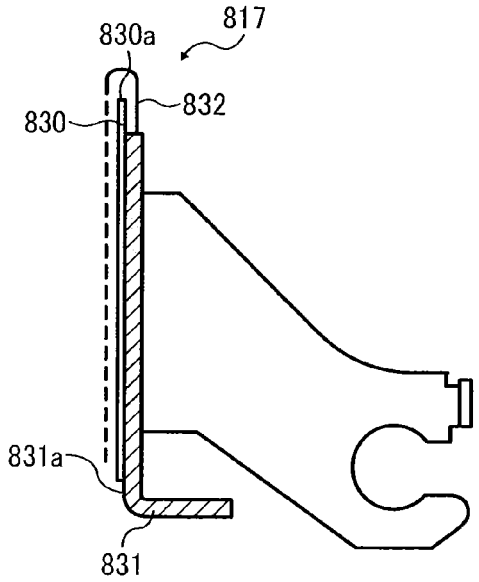
FIG. 1 RELATED ART
FIG. 1 is a side view of a related-art separator.
Figure 2:
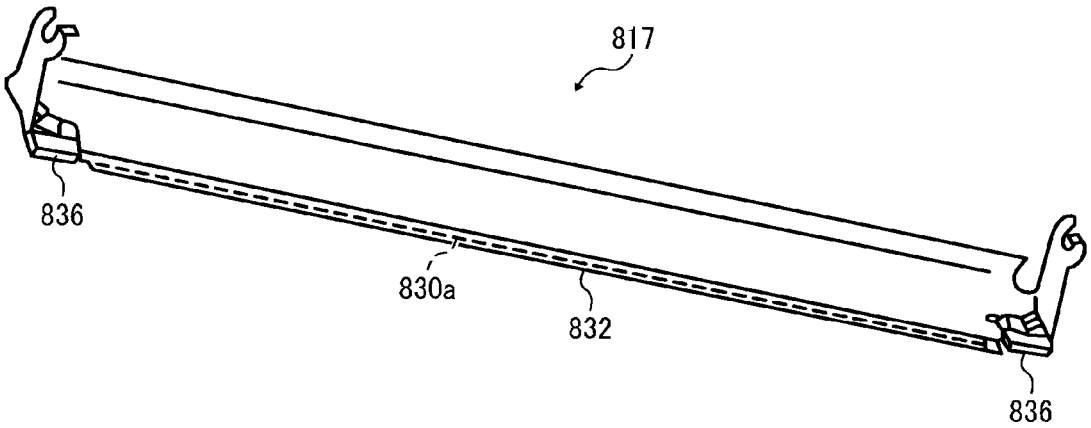
FIG. 2 RELATED ART
FIG. 2 is a perspective view of the separator in FIG. 1.
Figure 3:
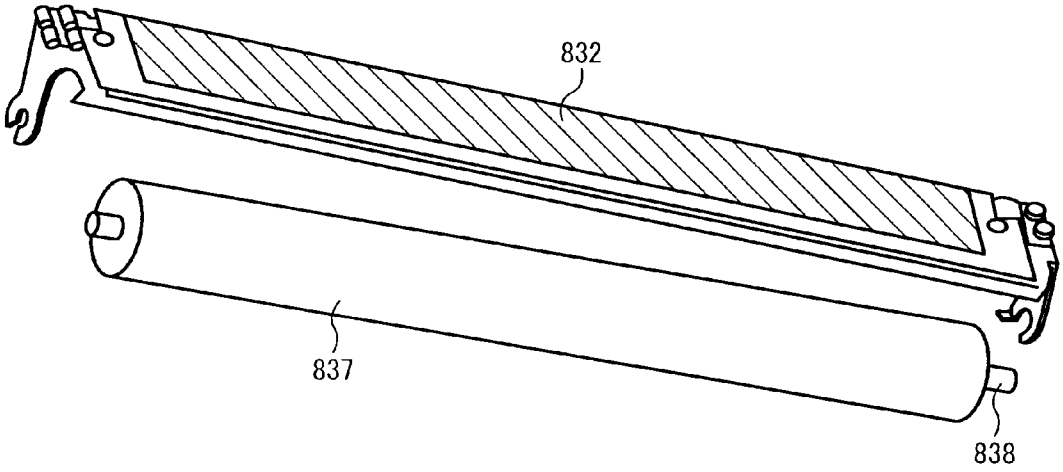
FIG. 3 RELATED ART
FIG. 3 is a perspective view illustrating relative positions of the separator in FIG. 1 and a fixing roller.
Figure 4:
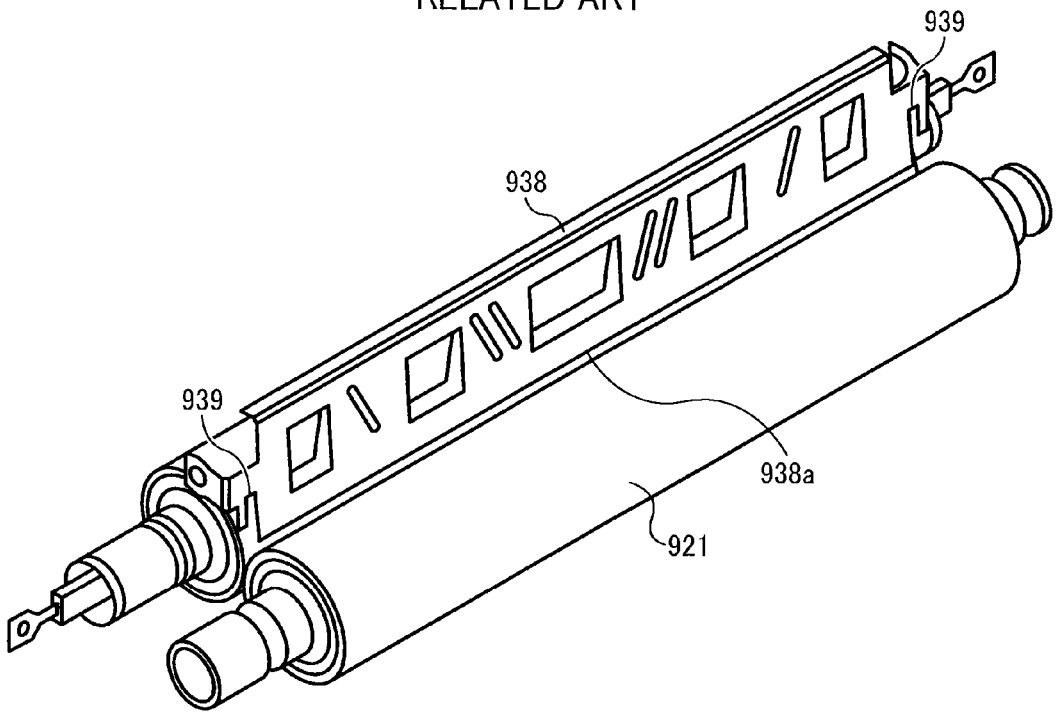
FIG. 4 RELATED ART
FIG. 4 is a perspective view of another related-art separator.
Figure 5:
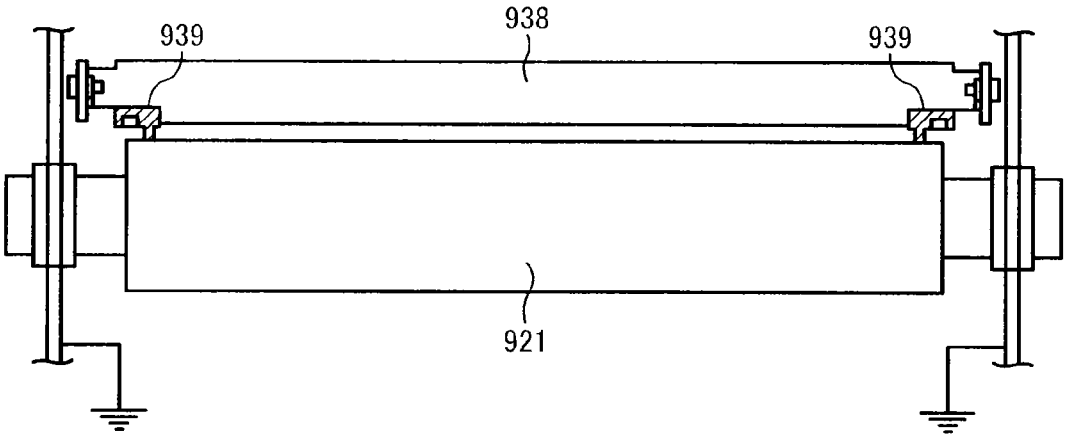
FIG. 5 RELATED ART
FIG. 5 is a front view of the separator in FIG. 4.
Figure 6:
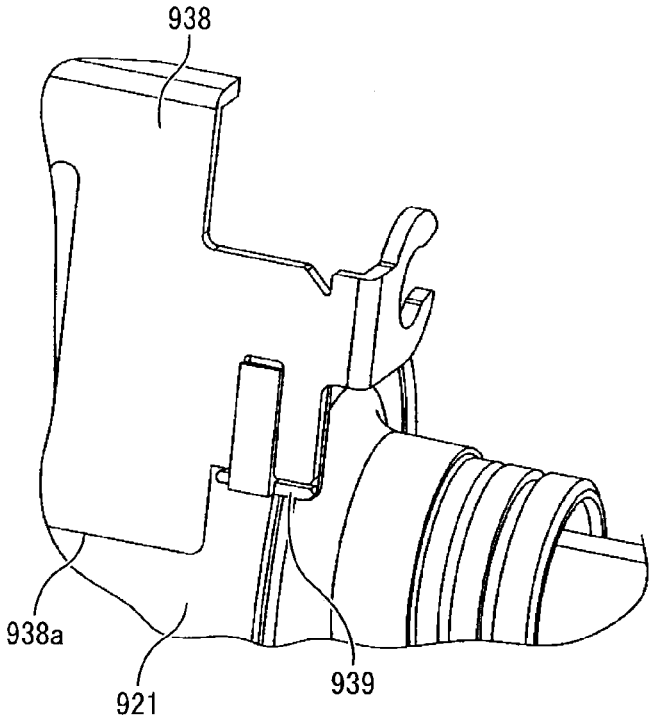
FIG. 6 RELATED ART
FIG. 6 is an enlarged partial perspective view of the separator in FIG. 4.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

With reference to FIGS. 7A to 10C, a separator 95 according to an embodiment of the present invention will first be described.

Figure 7A:
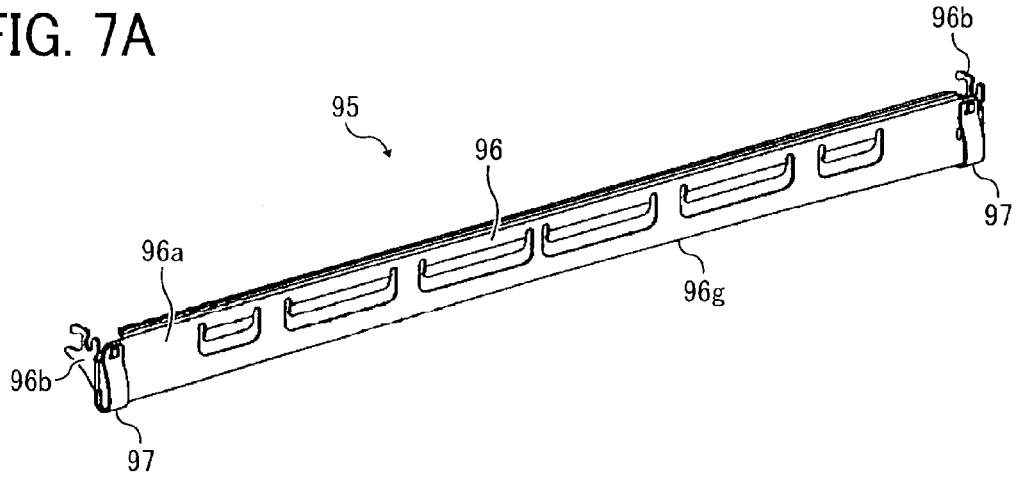
FIGS. 7A to 7C are a perspective view, an enlarged partial perspective view, and a side view, respectively, of a separator according to an embodiment of the present invention.
Figure 7B:
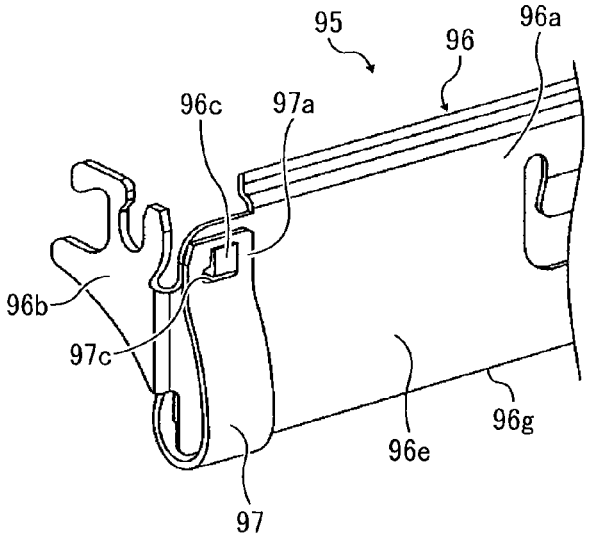
Figure 7C:
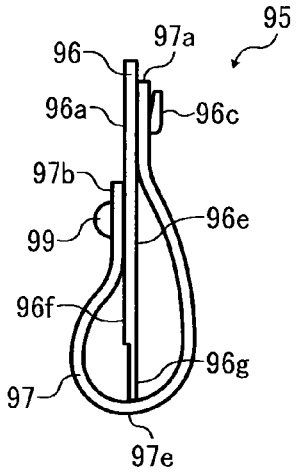
Figure 8A:
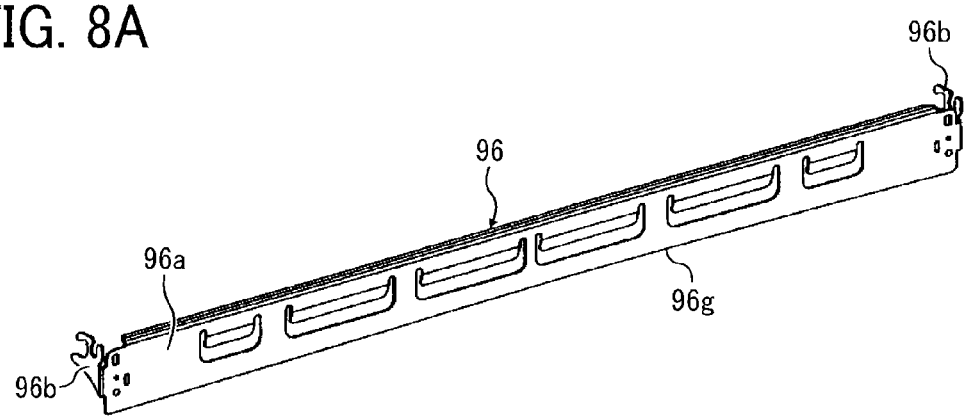
FIGS. 8A to 8C are a perspective view, an enlarged partial perspective view, and a side view, respectively, of a separation plate of the separator in FIGS. 7A to 7C.
Figure 8B:
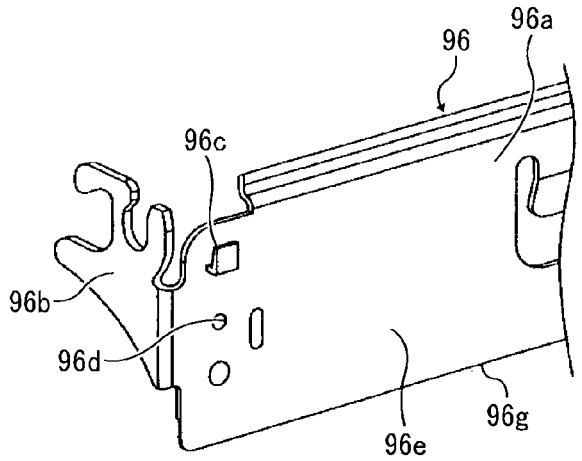
Figure 8C:
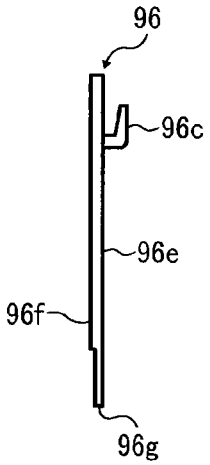
Figure 9A:
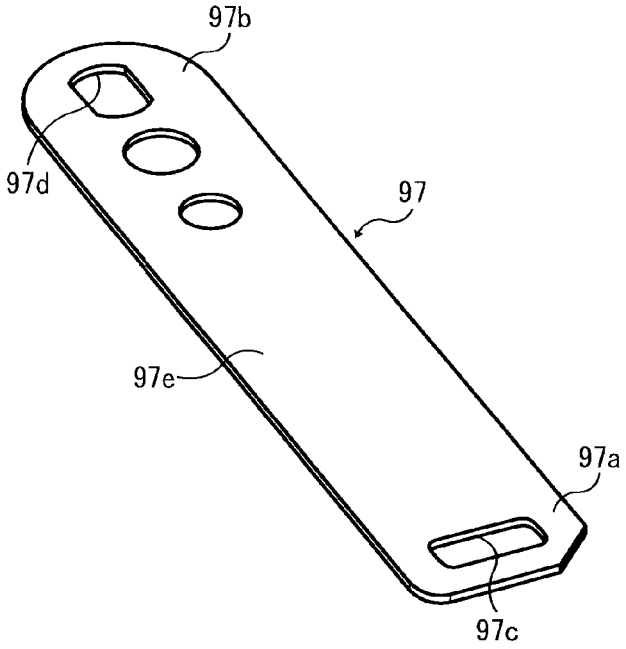
FIGS. 9A and 9B are a perspective view and a cross-sectional view, respectively, of a spacer of the separator in FIGS. 7A to 7C.
Figure 9B:
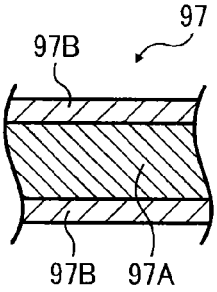
Figure 10A:
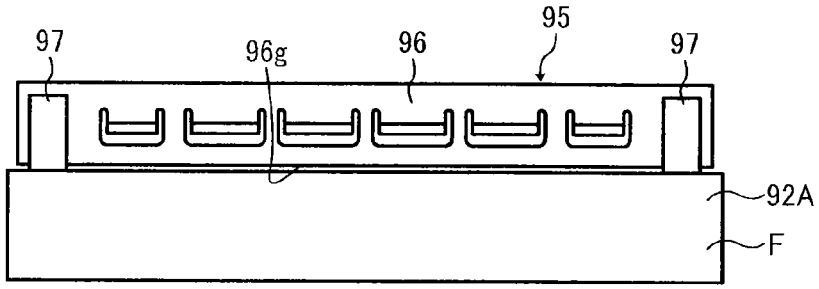
FIGS. 10A to 10C are a front view, an enlarged partial front view, and an enlarged side view, respectively, of the separator in FIGS. 7A to 7C disposed facing a fixing belt.
Figure 10B:
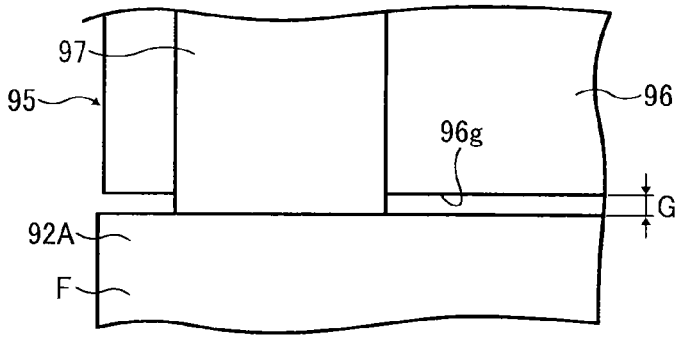
Figure 10C:
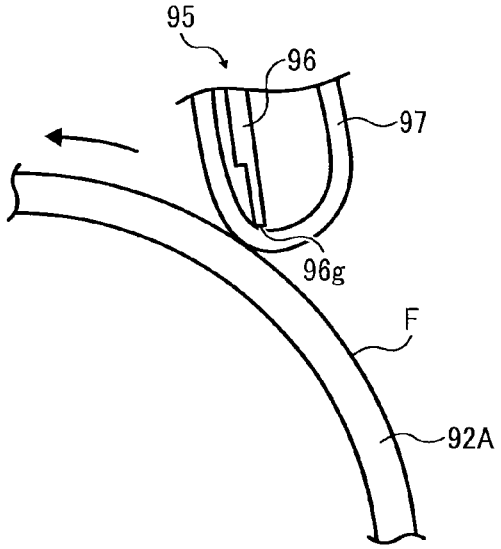

FIGS. 7A to 7C are a perspective view, an enlarged partial perspective view, and a side view, respectively, of the separator according the present embodiment. FIGS. 8A to 8C are a perspective view, an enlarged partial perspective view, and a side view, respectively, of a separation plate of the separator in FIGS. 7A to 7C. FIGS. 9A and 9B are a perspective view and a cross-sectional view, respectively, of a spacer of the separator in FIGS. 7A to 7C. FIGS. 10A to 10C are a front view, an enlarged partial front view, and an enlarged side view, respectively, of the separator in FIGS. 7A to 7C disposed facing a fixing belt.

Figure 11:
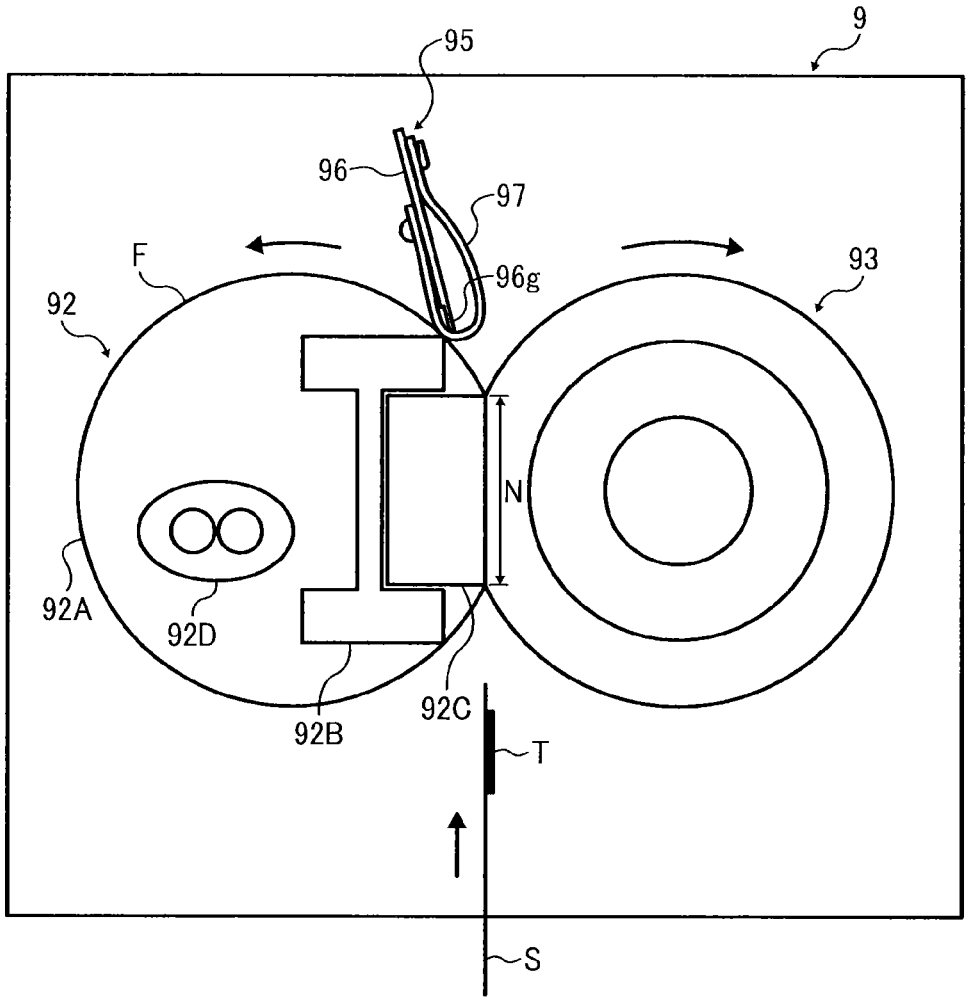
FIG. 11 is a schematic configuration diagram of a fixing device according to an embodiment of the present invention.

The separator 95 according to the present embodiment is employed in a fixing device including a fixing belt that fixes a toner image on a recording medium and a pressure roller pressed against the fixing belt to form a fixing nip portion for nipping the recording medium between the pressure roller and the fixing belt. A later-described fixing device 9 including a fixing belt 92A illustrated in FIG. 11 is an example of such a fixing device. In the present embodiment, the separator 95 is disposed downstream of the fixing nip portion in the medium feeding direction with a predetermined gap formed between the separator 95 and the fixing belt. The gap is wide enough to prevent the separator 95 from contacting the fixing belt but small enough to enable the separator 95 to separate the recording medium from the fixing belt to prevent the recording medium from winding around the fixing belt.

As illustrated in FIGS. 7A to 7C, the separator 95 includes a separation plate 96 and a pair of spacers 97. As illustrated in FIG. 8A, the separation plate 96 includes a separation plate body 96*a* and a pair of support portions 96*b*.

The separation plate body 96*a* is made of sheet metal or the like formed in a substantially planar band shape. As illustrated in FIG. 8B, each of opposed end portions in the longitudinal direction of the separation plate body 96*a* includes a hook 96*c* and a screw hole 96*d*. As illustrated in FIG. 7C, each of the spacers 97 includes one end portion 97*a* and the other end portion 97*b*. The one end portion 97*a* is hung on the hook 96*c*, and the other end portion 97*b* is fastened to the separation plate body 96*a* by a screw 99 screwed in the screw hole 96*d*. As illustrated in FIG. 8C, the separation plate body 96*a* includes one surface 96*e* and the other surface 96*f*, and the hook 96*c* projects from the one surface 96*e* of the separation plate body 96*a*, which faces the fed recording medium.

The paired support portions 96*b* are integrated with the opposed end portions in the longitudinal direction of the separation plate body 96*a* to project from the other surface 96*f* of the separation plate body 96*a*. Respective tip portions of the paired support portions 96*b* (i.e., portions on a side opposite to the side integrated with the separation plate body 96*a*) are attached to, for example, a frame (not illustrated) of the fixing device 9 to swingably support the separation plate body 96*a*.

As illustrated in FIG. 8C, the separation plate body 96*a* further includes an edge portion 96*g* in the lateral direction thereof (i.e., the vertical direction in FIGS. 7A to 8C). As illustrated in FIG. 10B, the separation plate 96 is disposed in the proximity of the fixing belt 92A of the fixing device 9 such that a predetermined gap G is formed between the fixing belt 92A and the edge portion 96*g* of the separation plate body 96*a*. As illustrated in FIG. 8C, the one surface 96*e* of the separation plate body 96*a* of the separation plate 96 is flat in the vicinity of the edge portion 96*g*, while the other surface 96*f* of the separation plate body 96*a* of the separation plate 96 has a recess in the vicinity of the edge portion 96*g* in the entire area along the extending direction of the edge portion 96*g* (i.e., the longitudinal direction of the separation plate body 96*a*).

As illustrated in FIG. 9A, the spacer 97 is a resin sheet member formed in a substantially planar band shape. The spacer 97 includes the one end portion 97*a* (i.e., an example of a first portion), the other end portion 97*b* (i.e., an example of a second portion), an intermediate portion 97*e* (i.e., an example of a third portion), a hook hole 97*c*, and a screw through-hole 97*d*. As illustrated in FIG. 9B, the spacer 97 includes a base material 97A and a surface layer 97B formed on the surface of the base material 97A. The base material 97A is made of, for example, a flexible synthetic resin such as acryl or polyester. The surface layer 97B is made of, for example, a fluorine-based resin such as tetrafluoroethylene-perfluoroalkyl vinyl ether copolymer (PFA) or polytetrafluoroethylene (PTFE).

In the present embodiment, the spacer 97 has a thickness of 0.3 mm. However, the thickness of the spacer 97 is, of course, not limited thereto, and may be set to a desired value in accordance with the width of the gap G to be formed between the separator 95 and the fixing belt 92A.

The paired spacers 97 are attached to the opposed end portions in the longitudinal direction of the separation plate body 96*a* of the separation plate 96. Specifically, the hook hole 97*c* provided in the one end portion 97*a* of each of the spacers 97 is engaged with the hook 96*c* of the separation plate body 96*a*. Thereby, the one end portion 97*a* of the spacer 97 is attached to the one surface 96*e* of the separation plate body 96*a* in a displaceable state, in which the one end portion 97*a* is somewhat displaceable from the installation position thereof. Further, the screw 99 inserted through the screw through-hole 97*d* of the other end portion 97*b* of the spacer 97 is screwed in the screw hole 96*d* of the separation plate body 96*a*. Thereby, the other end portion 97*b* of the spacer 97 is fixedly attached to the other surface 96*f* of the separation plate body 96*a*. That is, the paired spacers 97 are removably attached to the separation plate 96.

The intermediate portion 97*e* of the spacer 97 located between the hook hole 97*c* and the screw through-hole 97*d* is wrapped around the corresponding end portion of the edge portion 96*g* of the separation plate body 96*a* from the one surface 96*e* to the other surface 96*f*. In other words, the respective intermediate portions 97*e* of the spacers 97 are disposed to surround the opposed end portions of the edge portion 96*g* of the separation plate body 96*a* in a direction intersecting with the extending direction of the edge portion 96*g* (i.e., the longitudinal direction of the separation plate 96).

Further, as illustrated in FIG. 10A, respective installation positions of the paired spacers 97 and the installation interval therebetween are set such that, when the separator 95 is installed in the fixing device 9, the paired spacers 97 are in contact with regions of an outer circumferential surface F of the fixing belt 92A outside a fixing region of the outer circumferential surface F for fixing the toner image on the recording medium. Herein, the fixing region refers to the region that comes into contact with the recording medium to press and heat the recording medium. In the present embodiment, the paired spacers 97 are disposed to be in contact with opposed end portions in the width direction of the fixing belt 92A.

With reference to FIGS. 10A to 10C, the operation of the separator 95 according to the present embodiment will now be described.

The separator 95 is disposed such that the longitudinal direction of the separation plate 96 is parallel to the width direction of the fixing belt 92A (i.e., the horizontal direction in FIGS. 10A and 10B or a direction perpendicular to the drawing plane of FIG. 10C). Further, the separator 95 is disposed downstream of the fixing nip portion, as described above, and is pressed by a resilient member (not illustrated) such as a torsion spring such that the edge portion 96*g* of the separation plate 96 (specifically, the separation plate body 96*a*) rotates about the respective tip ends of the paired support portions 96*b* in a direction of approaching the outer circumferential surface F of the fixing belt 92A.

At the opposed end portions in the longitudinal direction of the edge portion 96*g* of the separation plate 96, therefore, the edge portion 96*g* is pressed against the outer circumferential surface F of the fixing belt 92A via the paired spacers 97. In this process, the edge portion 96*g* of the separation plate 96 is brought into contact with respective inner circumferential surfaces of the paired spacers 97. That is, the paired spacers 97 are held between the outer circumferential surface F of the fixing belt 92A and the opposed end portions of the edge portion 96*g* of the separation plate 96. Thereby, the gap G according to the thickness of the paired spacers 97 is formed between the outer circumferential surface F of the fixing belt 92A and a region of the edge portion 96*g* of the separation plate 96 located between the paired spacers 97.

The thus-formed gap G is unaffected by the shape tolerance (excluding the thickness tolerance) and the installation tolerance of the spacers 97 and the shape tolerance of the separation plate 96 (specifically, displacement in relative position between the installation positions of the spacers 97 and the edge portion 96*g*, for example). Further, since the size of the gap G depends only on the thickness of the spacers 97, it is possible to provide the accurate gap G by controlling the accuracy of the thickness of the spacers 97.

Further still, in the separator 95, the paired spacers 97 are attached to the separation plate 96 in the displaceable state. Therefore, the positions and postures of the paired spacers 97 are appropriately and autonomously adjusted with the rotation of the fixing belt 92A. Accordingly, fine adjustment of the installation positions of the paired spacers 97 is unnecessary, facilitating the assembly of the separator 95.

As described above, the separator 95 of the present embodiment includes the separation plate 96 disposed downstream of the fixing nip portion in the medium feeding direction such that the edge portion 96*g* of the separation plate 96 faces the outer circumferential surface F of the fixing belt 92A. The separator 95 further includes the plate-shaped spacers 97 disposed between the opposed end portions of the edge portion 96*g* of the separation plate 96 and the outer circumferential surface F of the fixing belt 92A to surround the opposed end portions of the edge portion 96*g* in the direction intersecting with the extending direction of the edge portion 96*g*. With the spacers 97 held between the opposed end portions of the edge portion 96*g* of the separation plate 96 and the outer circumferential surface F of the fixing belt 92A, therefore, the gap G corresponding to the thickness of the spacers 97 is formed between the region of the edge portion 96*g* of the separation plate 96 other than the opposed end portions of the edge portion 96*g* and the outer circumferential surface F of the fixing belt 92A. Therefore, the gap G is determined by the thickness of the spacers 97, and thus is unaffected by the shape tolerance and the installation tolerance of components. Accordingly, a reduction in accuracy of the gap G is effectively suppressed. Further, the size of the gap G is controllable by the thickness of the spacers 97, and thus is easily adjustable.

Further, in each of the spacers 97 made of a flexible material, the one end portion 97*a* is attached to the one surface 96*e* of the separation plate 96, the other end portion 97*b* separated from the one end portion 97*a* is attached to the other surface 96*f* of the separation plate 96, and the intermediate portion 97*e* located between the one end portion 97*a* and the other end portion 97*b* is wrapped around the corresponding end portion of the edge portion 96*g*. This configuration relaxes the positioning accuracy required of the spacers 97, allowing easy attachment of the spacers 97 to the separation plate 96 and facilitating the assembly of the separator 95, as compared with, for example, a configuration in which the entire spacers 97 are fixed to the separation plate 96. Further, the flexible spacers 97 are attached to both the one surface 96*e* and the other surface 96*f* of the separation plate 96. This configuration prevents curling of the spacers 97 occurring when the separation plate 96 bounces on the fixing belt 92A, as compared with a configuration in which the spacers 97 are attached to only one of the one surface 96*e* and the other surface 96*f* of the separation plate 96.

Further, the spacers 97 are removably attached to the separation plate 96, allowing the replacement of the spacers 97. It is therefore possible to easily adjust the gap G by preparing multiple types of spacers 97 with different thicknesses.

Further, the paired spacers 97 are displaceably fixed to the separation plate 96. With this configuration, the positions and postures of the paired spacers 97 are appropriately and autonomously adjusted with the rotation of the fixing belt 92A. Accordingly, fine adjustment of the installation positions of the spacers 97 is unnecessary, facilitating the assembly of the separator 95.

Further, in the separator 95, the spacers 97 have the surface layer 97B made of a fluorine-based resin. This configuration reduces abrasion of contact areas of the spacers 97 in contact with the fixing belt 92A, improving the durability of the spacers 97.

Further, in the separator 95, each of the spacers 97 has a rectangular shape in a plan view. Therefore, in the manufacture of the spacers 97 from a resin sheet base material, for example, a larger number of spacers 97 arc cut out of the single resin sheet base material than spacers 97 of a more complicated shape. Accordingly, the spacers 97 are easily manufactured at low cost.

Further, the spacers 97 are disposed to be in contact with the regions of the outer circumferential surface F of the fixing belt 92A outside the fixing region of the outer circumferential surface F. Therefore, the fixing region of the fixing belt 92A is prevented from receiving stress due to the contact with the spacers 97, and thus is capable of stably fixing the toner image on the recording medium.

With reference to FIG. 11, the fixing device 9 according to an embodiment of the present invention will now be described.

FIG. 11 is a schematic configuration diagram of the fixing device 9 according to an embodiment of the present invention. As illustrated in FIG. 11, the fixing device 9 includes the above-described separator 95, a heating mechanism 92, and a pressure roller 93. The separator 95 is configured to separate a sheet-shaped recording medium (also referred to as sheet, recording sheet, or transfer sheet, for example) S from the heating mechanism 92, (specifically, the fixing belt 92A).

The heating mechanism 92 includes the endless fixing belt 92A, a support member 92B, a nip forming member 92C, and a heat source 92D. The fixing belt 92A (i.e., an example of a rotary fixing member) is an endless belt made of a flexible synthetic resin material, for example. The support member 92B is disposed inside the loop formed by the fixing belt 92A to rotatably support the fixing belt 92A. The nip forming member 92C is disposed in and supported by a portion of the support member 92B facing the pressure roller 93. The pressure roller 93 is pressed against the nip forming member 92C via the fixing belt 92A, thereby forming a fixing nip portion N between the fixing belt 92A and the pressure roller 93. The heat source 92D, which, in the present embodiment, is a halogen heater, for example, is disposed inside a rotation locus of the fixing belt 92A.

The pressure roller 93 (i.e., an example of a rotary pressure member) includes a hollow metal roller, a silicone rubber layer laminated on the outer circumferential surface of the metal roller, and a fluorine-based resin layer forming a surface layer of the pressure roller 93. The fluorine-based resin layer is made of PFA, PTFE, or the like, and serves as a release layer. The pressure roller 93 further includes a shaft disposed parallel to the width direction of the fixing belt 92A (i.e., a direction perpendicular to the drawing plane of FIG. 11). The pressure roller 93 is driven to rotate by a drive motor (not illustrated), and is pressed toward the nip forming member 92C (i.e., toward the left side of FIG. 11) by a resilient member such as a spring (not illustrated).

As described above, the separator 95 includes the separation plate 96 and the paired spacers 97. The separator 95 is disposed downstream of the fixing nip portion N in the medium feeding direction (i.e., above the fixing nip portion N in FIG. 11) such that the outer circumferential surface F of the fixing belt 92A and the edge portion 96*g* face each other. Further, the paired spacers 97 are disposed between the opposed end portions of the edge portion 96*g* of the separation plate 96 and the outer circumferential surface F of the fixing belt 92A to surround the opposed end portions of the edge portion 96*g* in the direction intersecting with the extending direction of the edge portion 96*g*. Accordingly, the gap G according to the thickness of the paired spacers 97 is formed between the region of the edge portion 96*g* of the separation plate 96 located between the paired spacers 97 and the outer circumferential surface F of the fixing belt 92A.

In the fixing device 9, the pressure roller 93 is pressed against the fixing belt 92A in the fixing nip portion N. When the pressure roller 93 is driven to rotate while being pressed against the nip forming member 92C via the fixing belt 92A, therefore, the fixing belt 92A is rotated with the rotation of the pressure roller 93. Thereby, a portion of the fixing belt 92A heated by the heat source 92D is moved to the fixing nip portion N. With the rotation of the fixing belt 92A and the pressure roller 93, the recording medium S entering the fixing nip portion N is subjected to heat and pressure at the fixing nip portion N while being nipped and fed by the fixing belt 92A and the pressure roller 93. Thereby, a toner image T on the recording medium S is fixed thereon. The recording medium S having passed through the fixing nip portion N is then separated from the outer circumferential surface F of the fixing belt 92A by the separator 95 and fed downstream of the fixing device 9.

As described above, the fixing device 9 of the present embodiment includes the fixing belt 92A that fixes the toner image T on the recording medium S, the pressure roller 93 pressed against the fixing belt 92A to form the fixing nip portion N for nipping the recording medium S between the pressure roller 93 and the fixing belt 92A, and the separator 95 that separates the recording medium S from the fixing belt 92A. With this configuration, the spacers 97 of the separator 95 are held between the opposed end portions of the edge portion 96*g* of the separation plate 96 and the outer circumferential surface F of the fixing belt 92A. Accordingly, the gap G corresponding to the thickness of the spacers 97 is formed between the region of the edge portion 96*g* of the separation plate 96 other than the opposed end portions of the edge portion 96*g* (i.e., the region of the edge portion 96*g* located between the paired spacers 97) and the outer circumferential surface F of the fixing belt 92A. Therefore, the gap G is determined by the thickness of the spacers 97, and thus is unaffected by the shape tolerance and the installation tolerance of components. Accordingly, a reduction in accuracy of the gap G is effectively suppressed. Further, the size of the gap G is controllable by the thickness of the spacers 97, and thus is easily adjustable.

Figure 12:
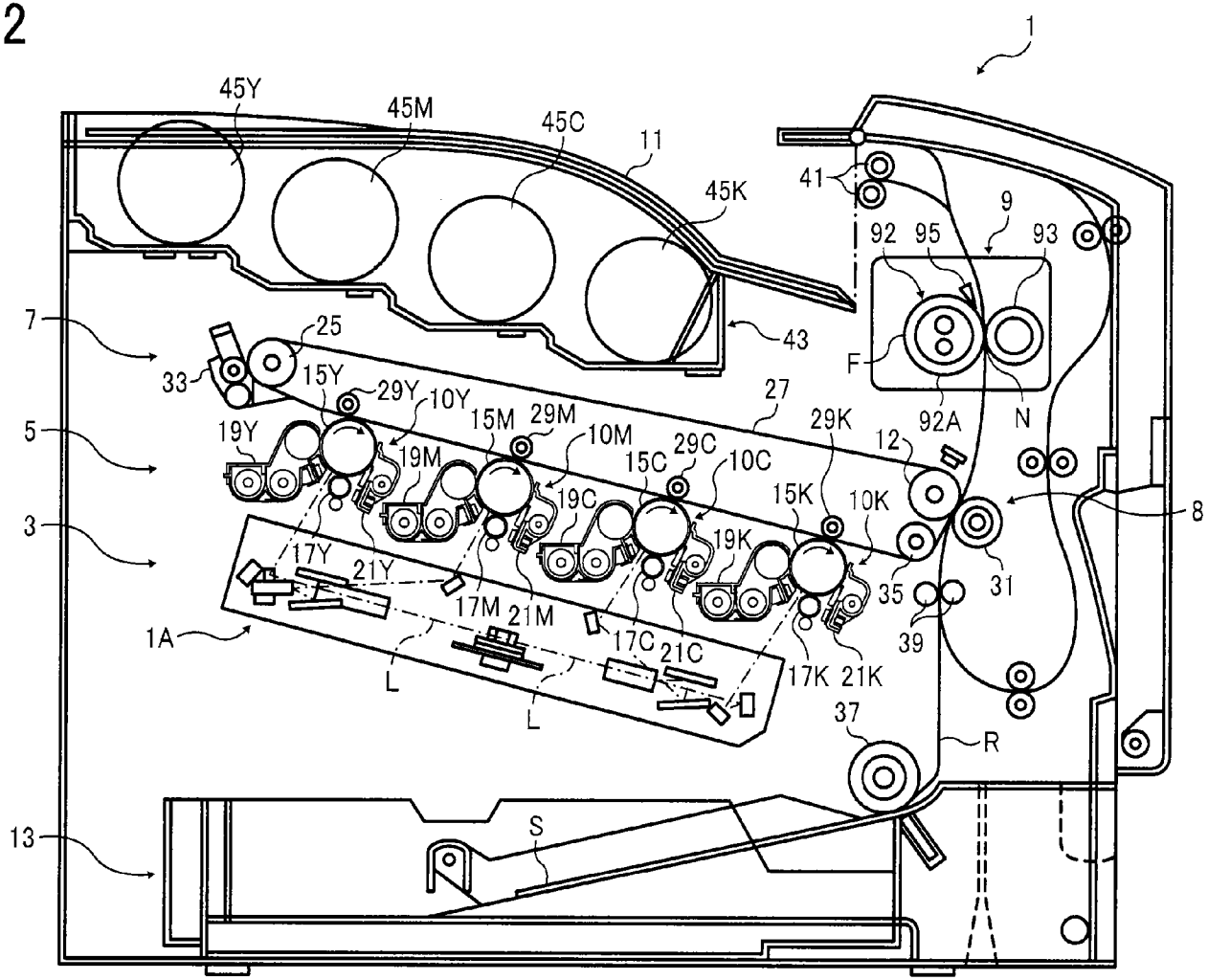
FIG. 12 is a schematic configuration diagram of an image forming apparatus according to an embodiment of the present invention.
Figure 13:
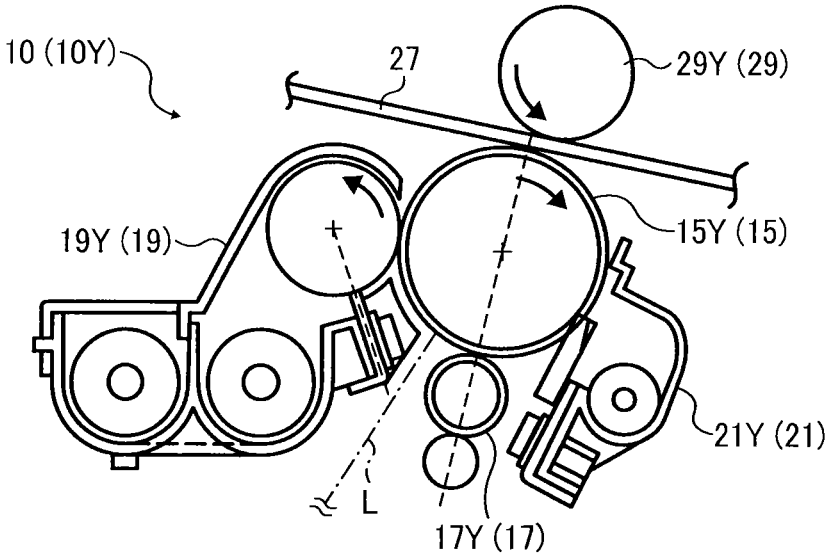
FIG. 13 is a schematic configuration diagram of a process cartridge of the image forming apparatus in FIG. 12.

With reference to FIGS. 12 and 13, an image forming apparatus according to an embodiment of the present invention will now be described.

FIG. 12 is a schematic configuration diagram of an image forming apparatus 1 according to an embodiment of the present invention. FIG. 13 is a schematic configuration diagram of a process cartridge included in the image forming apparatus 1 in FIG. 12. The image forming apparatus 1 according to the present embodiment forms and fixes a toner image on the sheet-shaped recording medium S. The image forming apparatus 1 may be a copier, a printer, a facsimile machine, or a multifunction machine combining the functions of these apparatuses, for example. In the present embodiment, the image forming apparatus 1 is a tandem full-color image forming apparatus. The image forming apparatus 1, however, may be a 4-cycle full-color image forming apparatus, for example. The image forming apparatus 1 includes at least an image forming unit that forms a toner image on the recording medium S and a fixing device that fixes the toner image formed on the recording medium S by the image forming unit.

The image forming apparatus 1 illustrated in FIG. 12 includes a sheet feeding tray 13, an image forming unit 1A, the fixing device 9 according to the foregoing embodiment, a stock tray 11, a bottle storage unit 43, and so forth. The image forming unit 1A includes an exposure device 3, a process unit 5, an intermediate transfer unit 7, and a secondary transfer unit 8.

The sheet feeding tray 13 stores a plurality of recording media S. The exposure device 3 emits laser beams L. The process unit 5 forms electrostatic latent images with the laser beams L and develops the electrostatic latent images to form toner images. The intermediate transfer unit 7 receives the toner images transferred thereto from the process unit 5. The secondary transfer unit 8 transfers the toner images from the intermediate transfer unit 7 onto one of the recording media S fed thereto from the sheet feeding tray 13. The fixing device 9 fixes the transferred toner images on the recording medium S. The stock tray 11 temporarily stores the recording medium S having the toner images transferred thereto.

The bottle storage unit 43 stores toner bottles 45Y, 45M, 45C, and 45K respectively filled with toners of yellow (Y), magenta (M), cyan (C), and black (K) colors (hereinafter referred to as the Y, M, C, and K colors).

The exposure device 3 directs the laser beams L onto respective outer circumferential surfaces of photoconductor drums 15Y, 15M, 15C, and 15K charged by charging devices 17Y, 17M, 17C, and 17K, respectively, in the process unit 5, to thereby form electrostatic latent images according to image data. The exposure device 3 includes light sources comprised of semiconductor lasers that radiate the laser beams L, an optical deflector that deflects the laser beams L in the main scanning direction, and optical scanning optical systems that condense the deflected laser beams L onto the outer circumferential surfaces of the photoconductor drums 15Y, 15M, 15C, and 15K to be scanned.

The process unit 5 sequentially performs a process of charging the outer circumferential surfaces of the photoconductor drums 15Y, 15M, 15C, and 15K, a process of developing the electrostatic latent images formed on the outer circumferential surfaces of the photoconductor drums 15Y, 15M, 15C, and 15K to form toner images, and a process of removing post-transfer residual toner remaining on the outer circumferential surfaces of the photoconductor drums 15Y, 15M, 15C, and 15K.

The process unit 5 includes process cartridges 10Y, 10M, 10C, and 10K for forming the toner images of the Y, M, C, and K colors. The process cartridges 10Y, 10M, 10C, and 10K are configured to be attachable to and detachable from the image forming apparatus 1 to be replaced with new ones when running out of life or expended.

As illustrated in FIG. 13, the process cartridge 10Y includes the photoconductor drum 15Y, the charging device 17Y, a development device 19Y, and a cleaning device 21Y. The charging device 17Y charges the photoconductor drum 15Y. The exposure device 3 directs the laser beam L onto the photoconductor drum 15Y to form thereon an electrostatic latent image. The development device 19Y develops the electrostatic latent image to form a toner image. The cleaning device 21Y cleans the outer circumferential surface of the photoconductor drum 15Y. The process cartridge 10Y stores the toner of the Y color corresponding to a color separation component of a color image to be formed. FIG. 13 also illustrates an intermediate transfer belt 27 and a primary transfer roller 29Y of the intermediate transfer unit 7.

The other process cartridges 10M, 10C, and 10K store toners of the M, C, and K colors, respectively, corresponding to the other color separation components of the color image. The process cartridges 10M, 10C, and 10K are similar in configuration to the above-described process cartridge 10Y, and include the photoconductor drums 15M, 15C, and 15K, the charging devices 17M, 17C, and 17K, development devices 19M, 19C, and 19K, and cleaning devices 21M, 21C, and 21K, respectively. Hereinafter, the suffixes Y, M, C, and K following reference numerals will be omitted where the distinction between the colors is unnecessary.

The photoconductor drum 15 is a cylindrically shaped aluminum pipe having an outer circumferential surface provided with an organic photosensitive layer. The electrostatic latent image is formed on the organic photosensitive layer of the photoconductor drum 15 with the laser beam L emitted for scanning in accordance with an image forming signal. The electrostatic latent image is then developed with the toner of the development device 19 to form an unfixed toner image.

The organic photosensitive layer includes an undercoat layer, a charge generation layer, a charge transport layer, and an overcoat layer. The undercoat layer coats the outer circumferential surface of the aluminum pipe. The charge generation layer generates positive charge and negative charge by photoelectric conversion. The charge transport layer transports the positive charge generated in the charge generation layer toward the outer circumferential surface of the photoconductor drum 15 to neutralize the negative charge on the outer circumferential surface. The overcoat layer improves the durability of the photoconductor drum 15.

The charging device 17 includes a charging member that supplies a charging bias to the outer circumferential surface of the photoconductor drum 15 to uniformly charge the outer circumferential surface to desired polarity and potential. The charging member may be, for example, an elastic charging roller or a scorotron charger including a wire electrode and a grid electrode.

The development device 19 performs the development process by causing the toner to adhere to the electrostatic latent image formed on the outer circumferential surface of the photoconductor drum 15. The development device 19 includes a development roller serving as a toner carrier and a magnet roller disposed inside the development roller to serve as a magnetic field generator. The development roller rotates while carrying the toner on the outer circumferential surface thereof, to thereby transport the toner to a development area facing the photoconductor drum 15.

The development roller is supplied with a development bias by a development bias power supply. In the development area, therefore, a potential difference is generated between the potential of the outer circumferential surface of the development roller and the potential of the electrostatic latent image on the outer circumferential surface of the photoconductor drum 15. The potential difference generates a development electric field, which causes the toner to adhere to the electrostatic latent image. Thereby, the electrostatic latent image on the photoconductor drum 15 is developed to form an unfixed toner image. The development device 19, however, is not limited to the above-described configuration, and may employ a commonly used configuration.

The cleaning device 21 removes the post-transfer residual toner remaining on the outer circumferential surface of the photoconductor drum 15 without being transferred to the intermediate transfer unit 7. The cleaning device 21 includes a blade member and a metal support member. The blade member scrapes off and removes the post-transfer residual toner on the outer circumferential surface of the photoconductor drum 15. The blade member is made of a synthetic resin such as a polyurethane resin and stuck to the metal support member. The blade member is in contact with the outer circumferential surface of the photoconductor drum 15 in a direction counter to the rotation direction of the photoconductor drum 15. In addition to the post-transfer residual toner, paper dust of the recording medium S, discharge products produced in the charging of the photoconductor drum 15 by the charging device 17, an additive to the toner, impurities included in the toner, and so forth are removed from the outer circumferential surface of the photoconductor drum 15 by the blade member.

Returning to FIG. 12, the intermediate transfer unit 7 transfers the toner images on the outer circumferential surfaces of the photoconductor drums 15Y, 15M, 15C, and 15K onto a surface of the recording medium S. The intermediate transfer unit 7 includes an endless intermediate transfer belt 27, a cleaning backup roller 25, a secondary transfer backup roller 12, a tension roller 35, a plurality of primary transfer rollers 29Y, 29M, 29C, and 29K, and a belt cleaning device 33.

The intermediate transfer belt 27 is stretched around and rotated by the cleaning backup roller 25, the secondary transfer backup roller 12, and the tension roller 35. The primary transfer rollers 29Y, 29M, 29C, and 29K face the photoconductor drums 15Y, 15M, 15C, and 15K for the respective colors, and press the intermediate transfer belt 27 against the photoconductor drums 15Y, 15M, 15C, and 15K. The intermediate transfer belt 27 is rotated counterclockwise in FIG. 12 while being stretched taut with predetermined tension by the tension roller 35. The intermediate transfer belt 27 has a single layer or multiple layers made of vinylidene fluoride resin, tetrafluoroethylene-ethylene copolymer resin, polyimide (PI) resin, and polycarbonate (PC) resin, for example, and dispersed with a conductive material such as carbon black.

The primary transfer rollers 29Y, 29M, 29C, and 29K contain a conductive material such as carbon black to be semiconducting. The primary transfer rollers 29Y, 29M, 29C, and 29K are supplied with a transfer bias opposite in polarity to the charge of the toners. Therefore, the primary transfer rollers 29Y, 29M, 29C, and 29K attract the toners toward the intermediate transfer belt 27 from the outer circumferential surfaces of the photoconductor drums 15Y, 15M, 15C, and 15K to thereby primary-transfer the toner images onto the intermediate transfer belt 27.

The secondary transfer unit 8 includes a secondary transfer roller 31. The secondary transfer roller 31 is disposed facing the secondary transfer backup roller 12 to press the recording medium S against the intermediate transfer belt 27. Similarly to the primary transfer rollers 29Y, 29M, 29C, and 29K, the secondary transfer roller 31 contains a conductive material such as carbon black to be semiconducting, and is supplied with a transfer bias opposite in polarity to the charge of the toners. Therefore, the secondary transfer roller 31 attracts the toners toward the recording medium S from the outer circumferential surface of the intermediate transfer belt 27 to thereby secondary-transfer the toner images onto the recording medium S.

The belt cleaning device 33 includes a cleaning blade, a blade holder, and a transport device. The cleaning blade in contact with the intermediate transfer belt 27 is made of an elastic material such as urethane rubber, and is removably held by the swingable blade holder. The cleaning blade is in contact with the intermediate transfer belt 27 in a direction counter to the rotation direction of the intermediate transfer belt 27 to block and remove post-transfer residual toner remaining on the outer circumferential surface of the intermediate transfer belt 27. With this configuration, the cleaning blade removes paper dust of the recording medium S, an additive to the toner, impurities included in the toner, and so forth, in addition to the post-transfer residual toner, from the outer circumferential surface of the intermediate transfer belt 27. The toner removed from the intermediate transfer belt 27 is transported to a toner collection unit to be stored therein by the transport device provided in the belt cleaning device 33.

The fixing device 9 supplies heat and pressure to the unfixed toner image on the recording medium S to fix the toner image thereon. The fixing device 9 includes the heating mechanism 92 including the fixing belt 92A, the pressure roller 93 pressed against the fixing belt 92A to drive and rotate the fixing belt 92A, and the separator 95.

The sheet feeding tray 13 is disposed in a lower part of the image forming apparatus 1. The sheet feeding tray 13 stores a plurality of recording media S (i.e., recording sheets). A recording medium S is picked up from the sheet feeding tray 13 and separated from the other recording media S by a sheet feed roller 37 to be fed to a sheet feed path R formed in the image forming apparatus 1.

The bottle storage unit 43 is disposed in an upper part of the image forming apparatus 1. The toner bottles 45Y, 45M, 45C, and 45K stored in the bottle storage unit 43 are filled with the toners of the Y, M, C, and K colors, respectively, corresponding to the color separation components of the color image. The toners of the respective colors in the toner bottles 45Y, 45M, 45C, and 45K are supplied as necessary to the development devices 19Y, 19M, 19C, and 19K of the process cartridges 10Y, 10M, 10C, and 10K by respective toner supply devices (not illustrated). The toner bottles 45Y, 45M, 45C, and 45K are configured to be attachable to and detachable from the image forming apparatus 1 independently of the process cartridges 10Y, 10M, 10C, and 10K.

Description will now be given of a basic operation of the above-configured image forming apparatus 1.

When the image forming apparatus 1 starts an image forming operation, the photoconductor drums 15Y, 15M, 15C, and 15K of the process cartridges 10Y, 10M, 10C, and 10K are driven to rotate clockwise in FIG. 12. Then, the outer circumferential surfaces of the photoconductor drums 15Y, 15M, 15C, and 15K are uniformly charged to predetermined polarity by the charging devices 17Y, 17M, 17C, and 17K, respectively.

Then, the exposure device 3 directs the laser beams L onto the charged outer circumferential surfaces of the photoconductor drums 15Y, 15M, 15C, and 15K to form thereon electrostatic latent images. In this process, unicolor image information of each of the Y, M, C, and K colors separated from a desired full-color image is used as the image information for the exposure of the photoconductor drums 15Y, 15M, 15C, and 15K.

The electrostatic latent images on the outer circumferential surfaces of the photoconductor drums 15Y, 15M, 15C, and 15K are then supplied with the toners by the development devices 19Y, 19M, 19C, and 19K, respectively. Thereby, the electrostatic latent images are developed to form toner images. Further, the primary transfer rollers 29Y, 29M, 29C, and 29K are supplied with a transfer bias opposite in polarity to the charge of the toners. Thereby, transfer electric fields are generated between the primary transfer rollers 29Y, 29M, 29C, and 29K and the photoconductor drums 15Y, 15M, 15C, and 15K. With the transfer electric fields, the toner images of the respective colors formed on the photoconductor drums 15Y, 15M, 15C, and 15K are sequentially superimposed on and transferred to the intermediate transfer belt 27 rotating counterclockwise in FIG. 12. Thereby, the intermediate transfer belt 27 carries a full-color toner image.

After the transfer of the toner images, post-transfer residual toners remaining on the outer circumferential surfaces of the photoconductor drums 15Y, 15M, 15C, and 15K are removed therefrom by the cleaning devices 21Y, 21M, 21C, and 21K, respectively. The outer circumferential surfaces of the photoconductor drums 15Y, 15M, 15C, and 15K are then subjected to a discharging process performed by respective discharging devices (not illustrated). Thereby, the surface potential of the photoconductor drums 15Y, 15M, 15C, and 15K is initialized to prepare for the next image forming operation.

Meanwhile, the sheet feed roller 37 is rotated by a driving device (not illustrated) to feed a recording medium S to the sheet feed path R from the sheet feeding tray 13. The recording medium S fed to the sheet feed path R is then fed to a nip portion between the secondary transfer roller 31 and the secondary transfer backup roller 12 facing each other by a registration roller pair 39 with proper timing. In this process, the secondary transfer roller 31 is supplied with a transfer bias opposite in polarity to the charge of the toners of the toner images on the intermediate transfer belt 27. Thereby, a transfer electric field is generated in the nip portion.

With the transfer electric field, the toner images on the intermediate transfer belt 27 are transferred at one time onto the recording medium S. After the transfer of the toner images, post-transfer residual toner remaining on the outer circumferential surface of the intermediate transfer belt 27 is removed by the belt cleaning device 33.

The recording medium S having the toner images transferred thereto is then fed to the fixing device 9, subjected to heat and pressure at the fixing nip portion N between the fixing belt 92A and the pressure roller 93. Thereby, the toner images are fixed on the recording medium S. The recording medium S having passed through the fixing nip portion N is separated from the outer circumferential surface F of the fixing belt 92A by the separator 95, and then is discharged onto the stock tray 11 from the fixing device 9 by sheet discharge rollers 41.

The above-described basic operation of the image forming apparatus 1 is performed to form a full-color image on the recording medium S. In addition to such an image forming operation, the image forming apparatus 1 may also perform an image forming operation of forming a unicolor image by using one of the process cartridges 10Y, 10M, 10C, and 10K and an image forming operation of forming a bicolor or tricolor image by using two or three of the process cartridges 10Y, 10M, 10C, and 10K.

As described above, the image forming apparatus 1 of the present embodiment includes at least the image forming unit 1A that forms a toner image on the recording medium S and the fixing device 9 that fixes the toner image formed on the recording medium S by the image forming unit 1A. In the fixing device 9, the spacers 97 of the separator 95 are held between the opposed end portions of the edge portion 96*g* of the separation plate 96 and the outer circumferential surface F of the fixing belt 92A. Thereby, the gap G corresponding to the thickness of the spacers 97 is formed between the region of the edge portion 96*g* of the separation plate 96 other than the opposed end portions of the edge portion 96*g* (i.e., the region of the edge portion 96*g* located between the paired spacers 97) and the outer circumferential surface F of the fixing belt 92A. Therefore, the gap G is determined by the thickness of the spacers 97, and thus is unaffected by the shape tolerance and the installation tolerance of components. Accordingly, a reduction in accuracy of the gap G is effectively suppressed. Further, the size of the gap G is controllable by the thickness of the spacers 97, and thus is easily adjustable.

The present invention is not limited to the configurations of the preferred embodiments described above.

Figure 14A:
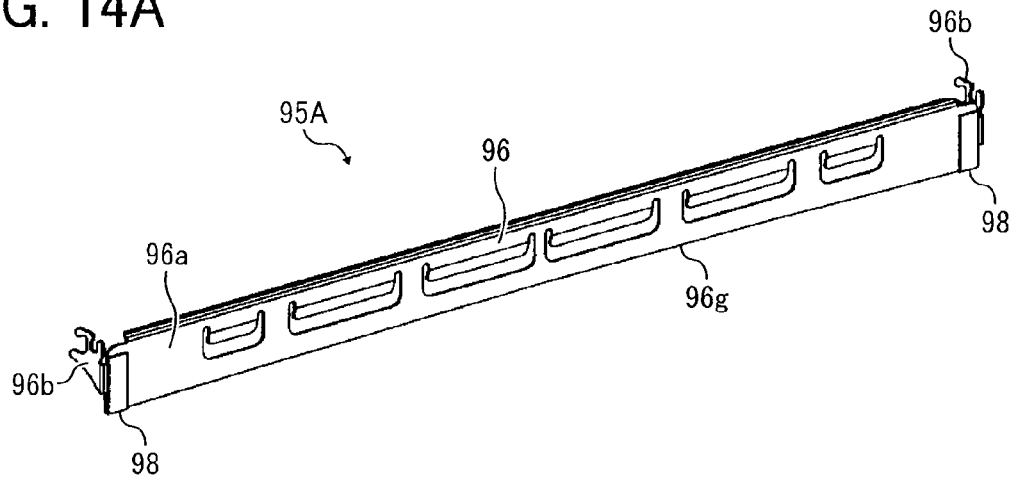
FIGS. 14A to 14C are a perspective view, an enlarged partial perspective view, and a side view, respectively, of a modified example of the separator in FIGS. 7A to 7C.
Figure 14B:
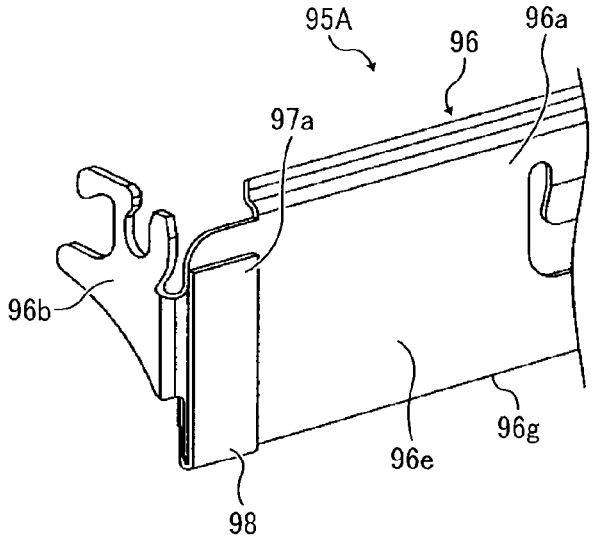
Figure 14C:
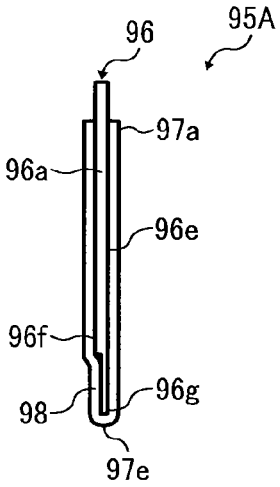

For example, although the paired spacers 97 are attached to the separation plate 96 in the displaceable state in the above-described embodiments, the configuration is not limited thereto. For example, as illustrated in FIGS. 14A to 14C, the separator 95 may be modified as a separator 95A that includes tape-shaped spacers 98 in place of the spacers 97. Each of the spacers 98 has a surface provided with an adhesive layer to stick the spacer 98 to the separation plate 96 from the one surface 96*e* to the other surface 96*f* via the edge portion 96*g*. This configuration also provides effects similar to those of the above-described embodiments. That is, when the spacers 98 are held between the opposed end portions of the edge portion 96*g* of the separation plate 96 and the outer circumferential surface F of the fixing belt 92A, the gap G corresponding to the thickness of the spacers 98 is formed between the region of the edge portion 96*g* of the separation plate 96 other than the opposed end portions of the edge portion 96*g* and the outer circumferential surface F of the fixing belt 92A. Therefore, the gap G is determined by the thickness of the spacers 98, and thus is unaffected by the shape tolerance and the installation tolerance of components. Accordingly, a reduction in accuracy of the gap G is effectively suppressed.

As described above, although the paired spacers 97 are attached to the separation plate 96 in the displaceable state in the above-described embodiments, the configuration is not limited thereto. The one end portion 97*a* of each of the spacers 97 may be fixed to the separation plate 96 by a screw or the like similarly to the other end portion 97*b* of the spacer 97. Alternatively, only one of the one end portion 97*a* and the other end portion 97*b* of the spacer 97 may be attached to the separation plate 96. With this configuration, the one end portion 97*a* or the other end portion 97*b* of the spacer 97 not attached to the separation plate 96 acts as a free end portion. This configuration also allows the positions and postures of the spacers 97 to be appropriately and autonomously adjusted similarly as in the above-described embodiments, when the fixing belt 92A is rotated with the spacers 97 held between the opposed end portions of the edge portion 96*g* of the separation plate 96 and the outer circumferential surface F of the fixing belt 92A.

Further, in the separator 95 of the above-described embodiments, the surface layer 97B made of a fluorine-based resin is provided over the entire surface of the base material 97A in each of the spacers 97. However, the surface layer 97B may be provided on at least a portion of the base material 97A to be in contact with the fixing belt 92A. In other words, it is sufficient if at least a portion of the surface of the spacer 97 to be in contact with the outer circumferential surface F of the fixing belt 92A is made of a fluorine-based resin. Alternatively, the base material 97A of the spacer 97 may be made of a smooth and durable material, such as PTFE, for example, to eliminate the need to provide a fluorine-based resin layer on the surface of the base material 97A. Further alternatively, the spacer 97 made of a resin material in the above-described embodiments may be formed by a thin stainless steel film, for example.

Further, although the separator 95 is disposed to separate the recording medium S from the fixing belt 92A in the fixing device 9 of the above-described embodiments, the configuration is not limited thereto. For example, the separator 95 may be disposed to separate the recording medium S from the outer circumferential surface of the pressure roller 93.

Further, although the image forming apparatus 1 of the above-described embodiment is a tandem full-color image forming apparatus including a plurality of aligned photoconductors, the image forming apparatus 1 is not limited thereto. For example, the image forming apparatus 1 may be a monochrome image forming apparatus or a revolver-type image forming apparatus, which includes a single photoconductor. The image forming apparatus 1 may be configured as desired within the purpose of the present invention, as long as the image forming apparatus 1 includes at least an image forming unit and a fixing device.

A separator, a fixing device, and an image forming apparatus according to embodiments of the present invention effectively suppress a reduction in accuracy of a gap formed between the separator and a rotary fixing member or a rotary pressure member. Specifically, according to embodiments of the present invention, a separation plate is disposed downstream of a fixing nip portion formed between the rotary fixing member and the rotary pressure member such that an edge portion of the separation plate faces the outer circumferential surface of the rotary fixing member or the rotary pressure member (i.e., the rotary member). Further, plate-shaped spacers are disposed between portions of the edge portion of the separation plate and the outer circumferential surface of the rotary member to surround the portions of the edge portion in a direction intersecting with an extending direction of the edge portion of the separation plate. With this configuration, when the spacers are held between the portions of the edge portion and the outer circumferential surface of the rotary member, a gap corresponding to the thickness of the spacers is formed between a region of the edge portion of the separation plate other than the portions of the edge portion and the outer circumferential surface of the rotary member. Therefore, the gap is determined by the thickness of the spacers, and thus is unaffected by the shape tolerance and the installation tolerance of components. Accordingly, a reduction in accuracy of the gap is effectively suppressed. Further, the size of the gap is controllable by the thickness of the spacers, and thus is easily adjustable.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A separator for use in a fixing device including a rotary fixing member that fixes a toner image on a recording medium and a rotary pressure member pressed against the rotary fixing member to form a fixing nip portion for nipping the recording medium between the rotary pressure member and the rotary fixing member, the separator comprising:

a separation plate disposed downstream of the fixing nip portion in a medium feeding direction, with an edge portion of the separation plate facing an outer circumferential surface of the rotary fixing member or the rotary pressure member; and plate-shaped spacers disposed between portions of the edge portion of the separation plate and the outer circumferential surface of the rotary fixing member or the rotary pressure member to surround the portions of the edge portion in a direction intersecting with an extending direction of the edge portion, the plate-shaped spacers each comprising a flexible film.

2. The separator according to claim 1, wherein the each of the spacers is made of a flexible material, and includes a first portion, a second portion separated from the first portion, and a third portion located between and continuous with the first portion and the second portion, and wherein the first portion of the spacer is attached to one surface of the separation plate, the second portion of the spacer is attached to another surface of the separation plate, and the third portion of the spacer is wrapped around a corresponding one of the portions of the edge portion of the separation plate.

3. The separator according to claim 1, wherein the spacers are removably attached to the separation plate.

4. The separator according to claim 1, wherein the spacers are displaceably fixed to the separation plate.

5. The separator according to claim 1, wherein at least a portion of a surface of each of the spacers is in contact with the outer circumferential surface of the rotary fixing member or the rotary pressure member and is made of a fluorine-based resin.

6. The separator according to claim 1, wherein each of the spacers has a rectangular shape in plan view.

7. The separator according to claim 1, wherein the spacers are fixedly adhered to the separation plate.

8. The separator according to claim 1, wherein the spacers are disposed to be in contact with regions of the outer circumferential surface of the rotary fixing member or the rotary pressure member outside a fixing region of the outer circumferential surface.

9. The separator according to claim 1, wherein the plate-shaped spacers are formed from a generally planar element and arranged such that a plane of the element is parallel to the extending direction when the plate-shaped spacers surround the portions of the edge portion.

10. The separator according to claim 1, wherein:

the plate-shaped spacers surround the edge portion on two sides and also a tip of the edge portion.

11. The separator according to claim 9, wherein:

the plate-shaped spacers surround the edge portion on two sides and also a tip of the edge portion.

12. A fixing device comprising:

a rotary fixing member configured to fix a toner image on a recording medium;

a rotary pressure member configured to be pressed against the rotary fixing member to form a fixing nip portion for nipping the recording medium between the rotary pressure member and the rotary fixing member; and a separator configured to separate the recording medium from the rotary fixing member or the rotary pressure member, wherein the separator includes a separation plate disposed downstream of the fixing nip portion in a medium feeding direction, with an edge portion of the separation plate facing an outer circumferential surface of the rotary fixing member or the rotary pressure member, and plate-shaped spacers disposed between portions of the edge portion of the separation plate and the outer circumferential surface of the rotary fixing member or the rotary pressure member to surround the portions of the edge portion in a direction intersecting with an extending direction of the edge portion, the plate-shaped spacers each comprising a flexible film.

13. The fixing device according to claim 12, wherein the plate-shaped spacers are formed from a generally planar element and arranged such that a plane of the element is parallel to the extending direction when the plate-shaped spacers surround the portions of the edge portion.

14. The fixing device according to claim 12, wherein:

the plate-shaped spacers surround the edge portion on two sides and also a tip of the edge portion.

15. The fixing device according to claim 13, wherein:

the plate-shaped spacers surround the edge portion on two sides and also a tip of the edge portion.

16. An image forming apparatus comprising:

an image forming unit configured to form a toner image on a recording medium; and a fixing device configured to fix the toner image formed on the recording medium by the image forming unit, wherein the fixing device includes a rotary fixing member configured to fix the toner image on the recording medium, a rotary pressure member configured to be pressed against the rotary fixing member to form a fixing nip portion for nipping the recording medium between the rotary pressure member and the rotary fixing member, and a separator configured to separate the recording medium from the rotary fixing member or the rotary pressure member, and wherein the separator includes a separation plate disposed downstream of the fixing nip portion in a medium feeding direction, with an edge portion of the separation plate facing an outer circumferential surface of the rotary fixing member or the rotary pressure member, and plate-shaped spacers disposed between portions of the edge portion of the separation plate and the outer circumferential surface of the rotary fixing member or the rotary pressure member to surround the portions of the edge portion in a direction intersecting with an extending direction of the edge portion, the plate-shaped spacers each comprising a flexible film.

17. The image forming apparatus according to claim 16, wherein the plate-shaped spacers are formed from a generally planar element and arranged such that a plane of the element is parallel to the extending direction when the plate-shaped spacers surround the portions of the edge portion.

18. The image forming apparatus according to claim 16, wherein:

the plate-shaped spacers surround the edge portion on two sides and also a tip of the edge portion.

19. The image forming apparatus according to claim 17, wherein:

the plate-shaped spacers surround the edge portion on two sides and also a tip of the edge portion.

* * * * *